US007018083B2

(12) United States Patent
Lanbach

(10) Patent No.: US 7,018,083 B2
(45) Date of Patent: Mar. 28, 2006

(54) LIGHTING SYSTEM

(75) Inventor: Bruno Lanbach, Mils (AT)

(73) Assignee: D. Swarovski & Co., Wattens (AT)

( * ) Notice: Subject to any disclaimer, the term of this patent is extended or adjusted under 35 U.S.C. 154(b) by 70 days.

(21) Appl. No.: 10/391,553

(22) Filed: Mar. 20, 2003

(65) Prior Publication Data

US 2003/0179568 A1 Sep. 25, 2003

(30) Foreign Application Priority Data

Mar. 22, 2002 (AT) ..... A 444/2002

(51) Int. Cl.
*F21V 5/00* (2006.01)
*F21V 21/002* (2006.01)

(52) U.S. Cl. ..... 362/555; 362/565; 362/806

(58) Field of Classification Search ..... 362/555, 362/565, 566, 806, 104, 800, 121, 391, 226, 362/186, 431, 353; 63/13; 428/17
See application file for complete search history.

(56) References Cited

U.S. PATENT DOCUMENTS 4,271,457 A * 6/1981 Martin ..... 362/104
4,912,609 A * 3/1990 Gillette ..... 362/147
5,274,537 A * 12/1993 Altman ..... 362/353
5,311,417 A 5/1994 Heh
5,477,433 A 12/1995 Ohlund
5,653,530 A 8/1997 Pittman
5,685,635 A * 11/1997 Barthelmess ..... 362/249
5,704,704 A * 1/1998 Reichard et al. ..... 362/477
5,876,109 A 3/1999 Scalco
5,911,501 A * 6/1999 Katz ..... 362/267
6,086,220 A * 7/2000 Lash et al. ..... 362/244
6,122,933 A 9/2000 Ohlund
6,233,971 B1 * 5/2001 Ohlund ..... 63/3
6,328,457 B1 * 12/2001 Huang ..... 362/353
6,568,824 B1 * 5/2003 Jantz et al. ..... 362/104
6,578,981 B1 * 6/2003 Jackson et al. ..... 362/104
2001/0055205 A1 12/2001 Kamara
2002/0159256 A1 * 10/2002 Chen ..... 362/226
2004/0095749 A1 * 5/2004 Bilotti ..... 362/102

FOREIGN PATENT DOCUMENTS

DE 20017577 U1 2/2001
DE 20112051 2/2002

* cited by examiner

*Primary Examiner*—Y. My Quach-Lee
*Assistant Examiner*—Peggy A. Neils
(74) *Attorney, Agent, or Firm*—Wenderoth, Lind & Ponack, L.L.P.

(57) ABSTRACT

A lighting system has at least one decorative transparent member which has at least one bore with at least one light source for illuminating the at least one decorative transparent member. The lightning system further has a mechanical holder which extends into the bore for holding or hanging the at least one decorative transparent member. Each light source is arranged in the bore of the respective decorative transparent member, and the current supply to each light source takes place through the respective holder.

25 Claims, 2 Drawing Sheets

LIGHTING SYSTEM

BACKGROUND INVENTION

The present invention relates to a lighting system having at least one decorative transparent member which has at least one bore, with at least one light source for illuminating the at least one decorative transparent member, and having a mechanical holder which extends into the bore for holding or hanging the at least one decorative transparent member.

Lighting systems with a decorative transparent member, for example in the form of an ornament, have long been known. Their aesthetic appeal is increased by locating a light source either on or in the decorative transparent member because of the multiple reflections of, and interruptions to, the light emerging from the decorative transparent member.

There are many different embodiments of a decorative lighting system. U.S. Pat. No. 5,656,530 discloses a lighting system, for example, in which the light source is located in an opaque holder which is connected by a wire to the decorative transparent member. U.S. Pat. No. 5,876,109 describes a lighting system with a decorative transparent member in the form of an ornament in which a light source is arranged in a blind bore which is made specifically for the purpose. The holder is outside the bore.

The aim of the invention is to create a lighting system which is of simple construction and visually appealing.

SUMMARY OF THE INVENTION

This object is obtained according to the invention because each light source is arranged in the bore of the respective decorative transparent member, and the current supply is supplied to each light source through the respective holder.

This invention is advantageous economically and technically because it is possible for the light source to be introduced into the bore of the decorative transparent member which was already needed hitherto for the mechanical holder. This avoids the need for any modifications to existing devices which would be costly economically and technically. Particularly advantageously, a customary lustre ornament with a bore can be used without modification. The bore carries out the dual role of receiving the holder (as was the case hitherto) and the light source. This is now advantageous in that the light source does not require any separate holder. Instead, good light is introduced into the decorative transparent member by way of the light source which is disposed inside the bore.

One advantageous embodiment of the invention provides that a light diode (LED) is selected as the light source. This combines compact design with high light intensity and a low current requirement.

Another advantageous embodiment of the invention results if a light diode is accommodated in a recessed manner in a recess provided for it in the part of the mechanical holder disposed in the bore. This allows the light source to be located in a decorative transparent member which was not originally designed for that purpose.

Another advantageous embodiment of the invention results if the decorative transparent member of the lighting system has a plurality of blind bores into each of which a light diode can be placed. This permits the uniform internal illumination of larger decorative transparent members.

Another advantageous embodiment of the invention results if the mechanical holder of the lighting system is designed in the region of the decorative transparent member as two straps held under spring tension and permitting frictional fixture of the light sources which are placed loosely in the respective bore. This embodiment is particularly user-friendly because of the possibility to change over defective light sources quickly.

Another advantageous embodiment of the invention results if the mechanical holder consists largely of glass fibre-reinforced plastic material, preferably epoxy resin. A mechanical holder is produced thereby which has advantageous mechanical properties and low inherent weight.

Another advantageous embodiment of the invention results if the mechanical holder, in the region of the decorative transparent member, is in the form of an elongated strap. This permits a plurality of light sources to be accommodated in the same bore.

Another advantageous embodiment of the invention results if two oppositely disposed sides of the mechanical holder are coated over the entire length thereof at least partially with an electrically conductive layer. The presence of conductive layers permits cable-free current supply from light sources which are contacted by the mechanical holder. This is advantageous in aesthetic terms.

Another advantageous embodiment of the invention results if the mechanical holder is in the form of a hook-type suspension means in the region of the free end which is remote from the bore, and if the hook-type suspension means has electrically conductive contact faces, each of which is connected to a conductive layer. As a result, the lighting system can be detachably suspended from any form of conductor rail, wherein the gravitational force acts as a contact pressure, and costly screwing or clamping of the lighting system to the conductor rail becomes redundant. The avoidance of connecting the lighting system to an external current source, which is costly in technical terms, results in low susceptibility to interference. A particularly advantageous aspect of this embodiment is the ability to arrange a plurality of lighting systems in freely selectable locations on one and the same conductor rail.

BRIEF DESCRIPTION OF THE DRAWINGS

Further features and details of the present invention will emerge from the following description of the accompanying drawings, wherein.

DETAILED DESCRIPTION OF THE INVENTION

Figure 1A:
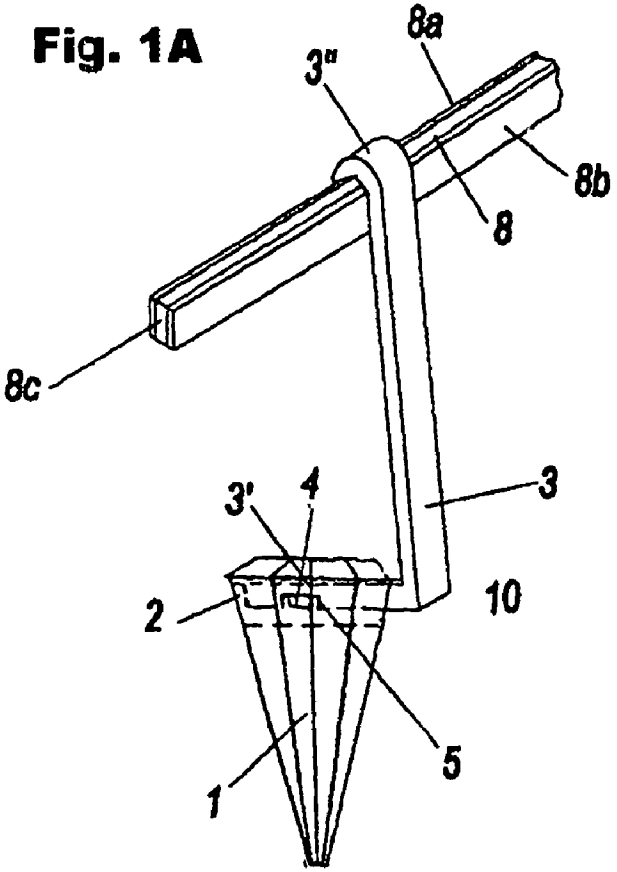
FIGS. 1A to 1E show a lighting system according to the invention, and also various detailed views of the same.
Figure 1B:
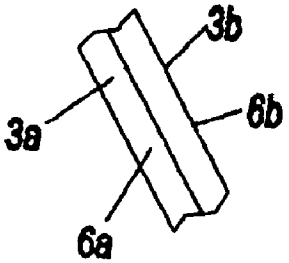
Figure 1D:
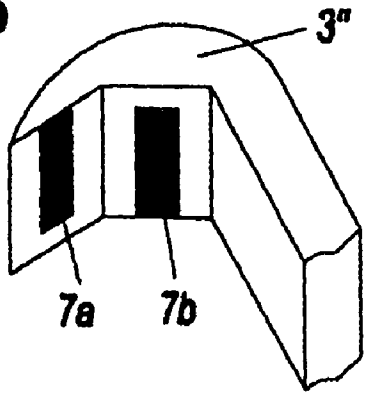
Figure 1C:
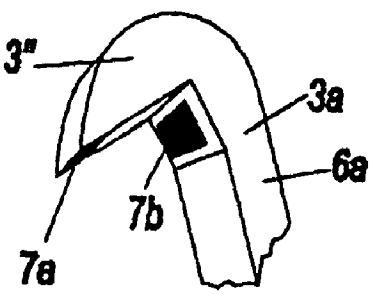
Figure 1E:
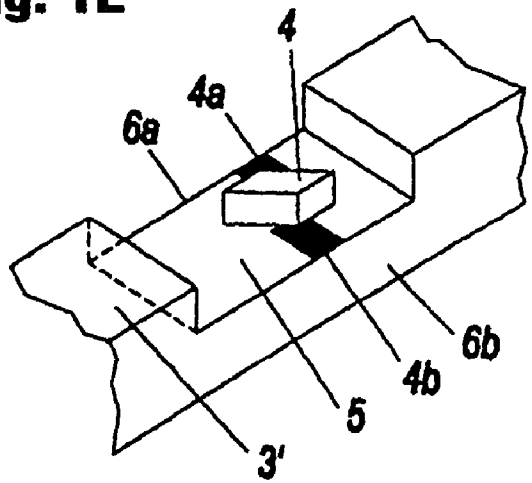

FIG. 1A shows a lighting system 10 with a decorative transparent member 1 in the form of a lustre ornament which is provided with a substantially horizontally-extending (through)bore 2 by means of which it is suspended detachably to a mechanical holder 3. As shown in FIG. 1A, the mechanical-holder 3 has an arm part 3' extending from a main body part, and the mechanical holder 3 is sufficiently stiff (or even rigid) to support the decorative transparent 1. A light diode 4 is secured in a recessed manner, in a recess 5, to the arm part 3' of the stiff mechanical holder 3 disposed in the continuous cylindrical bore 2. The supply of current is by way of the conductive layers 6*a*, 6*b* (see FIG. 1B) which are disposed on the lateral faces 3*a*, 3*b* of the mechanical holder 3, and which extend over the entire length of the holder 3, and which open into contact faces 7*a*, 7*b* which are mutually oppositely disposed with respect to each other at an angle, at the side, remote from the conductor rail, of the top region 3" of the holder 3. The top region 3"is in the form of a suspension member (see FIGS. 1C and 1D). The electrical connection to an external current source happens by way of the contact pressure of the suspension member 3", produced by gravitational force, upon a contact rail 8 of a bar-like design. The contact rail 8 has different electric potentials on opposite lateral faces 8*a*, 8*b* arranged on either side of an insulating layer 8*c*. FIG. 1E shows a detailed view of the recess 5, where contacting of the various poles 4*a*, 4*b* of the light source 4 (in the form of a light diode in this embodiment) can be seen.

Figure 2:
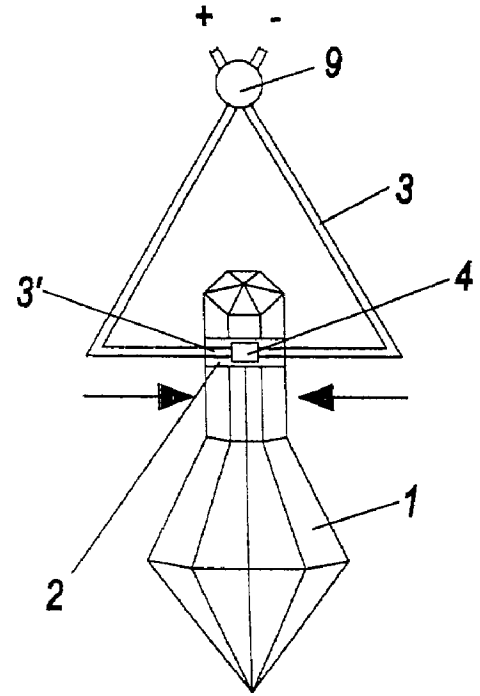
FIG. 2 shows another embodiment of the invention.

FIG. 2 shows another embodiment of the invention. Here, the light diode 4 is accommodated loosely in the through-bore 2 of the decorative transparent member 1, and is electrically contacted on both sides of the bore 2 by the mechanical holder 3. As shown in the Figure, the mechanical holder 3 is designed in the region of the decorative transparent member 1 as a clamp 9 held under spring tension. As a result, the electric circuit across the light diode 4 is closed.

Figure 3:
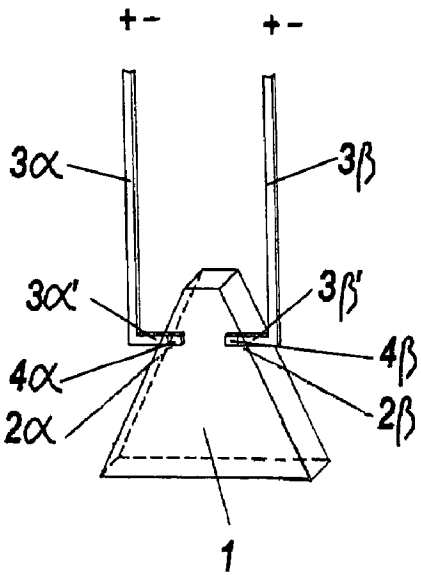
FIG. 3 shows another embodiment of the invention.

FIG. 3 shows another embodiment of a lighting system 10 according to the invention, wherein two light diodes 4α, 4β are disposed in opposite blind bores 2α, 2β (i.e., the blind bores 2α, 2β are located in opposite side areas of the decorative transparent member 1). The current supply to the light diodes 4α, 4β is effected by way of the respective mechanical holder 3α, 3β.

Figure 4:
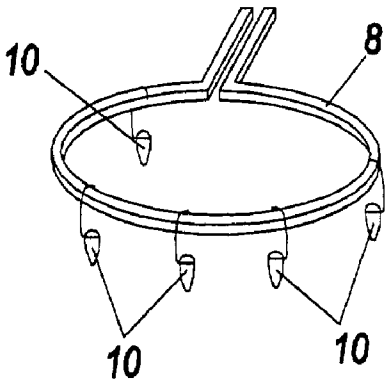
FIG. 4 shows an example of an application in which a plurality of lighting systems according to the invention is used.

FIG. 4 shows an example of an application where a plurality of lighting systems 10 according to the invention are suspended detachably from an annular conductor rail 8.

Clearly, the invention is not limited to the embodiments shown. For example, a light bulb, possibly colored, can be used as the light source, the decorative transparent member can be designed as an ornament, the decorative transparent member can have both through-bores as well as blind bores, a plurality of decorative transparent members can be arranged on a mechanical holder, or the decorative transparent member can have a color which is inherent to itself.

The invention claimed is:

1. A lighting system comprising:

a decorative transparent member having a bore formed therein;

a stiff mechanical holder having an arm part extending into said bore of said decorative transparent member such that said stiff mechanical holder supports said decorative transparent member; and a light source supported by said arm part of said stiff mechanical holder and located within said bore of said decorative transparent member, said stiff mechanical holder being operable to supply electrical current to said light source via said arm part;

wherein said mechanical holder has a stiff construction; and wherein said mechanical holder has a first end and a second end, said arm part being located at said second end, said first end having a hook-shaped suspension member.

2. The lighting system of claim 1, wherein said stiff mechanical holder comprises a rigid mechanical holder.

3. The lighting system of claim 1, wherein said light source comprises a light emitting diode.

4. The lighting system of claim 1, wherein said light source is fixed to said arm part of said stiff mechanical holder.

5. The lighting system of claim 1, wherein said light source is inserted loosely into said bore, and said stiff mechanical holder electrically contacts said light source or a mount of said light source.

6. The lighting system of claim 1, wherein said bore comprises a through-bore.

7. The lighting system of claim 1, wherein said bore comprises a blind bore.

8. The lighting system of claim 7, wherein said blind bore comprises a first blind bore, said decorative transparent member further having a second blind bore formed therein and arranged opposite said first blind bore.

9. The lighting system of claim 1, wherein said bore has a diameter less than 5 mm.

10. The lighting system of claim 1, wherein said decorative transparent member comprises a facetted glass body.

11. The lighting system of claim 1, wherein said decorative transparent member comprises a lustre decoration.

12. The lighting system of claim 1, wherein the decorative transparent member is an ornament.

13. The lighting system of claim 1, wherein said bore extends though said decorative transparent member in a substantially horizontal direction.

14. The lighting system of claim 1, wherein said bore is cylindrical and has a uniform diameter.

15. The lighting system of claim 1, wherein said arm part of said stiff mechanical holder is removably inserted into said bore.

16. A mechanical holder for a decorative transparent member of a lighting system, wherein:

said decorative transparent member has a bore formed therein;

said mechanical holder has a stiff construction with a first end and a second end, has an arm part located at said second end and extending into said bore of said decorative transparent member such that said stiff mechanical holder supports said decorative transparent member, and has a hook-shaped suspension member located at said first end; and a light source is supported by said arm part of said stiff mechanical holder and is located within said bore of said decorative transparent member, said stiff mechanical holder being operable to supply electrical current to said light source via said arm part.

17. The mechanical holder of claim 16, wherein said mechanical holder is made of reinforced plastic material.

18. The mechanical holder of claim 16, wherein said arm part of said mechanical holder is shaped as an elongated strap.

19. The mechanical holder of claim 18, wherein said strap has an opening, said light source being arranged in said opening.

20. The mechanical holder of claim 16, wherein said mechanical holder has two opposite sides each at least partially coated over an entire length thereof with an electrically conductive layer.

21. The mechanical holder of claim 20, wherein a first electrically conductive layer at least partially coated over a first one of said two opposite sides is electrically connected to a first pole of said light source, and a second electrically conductive layer at least partially coated over a second one of said two opposite sides is electrically connected to a second pole of said light source.

22. The mechanical holder of claim 16, wherein said hook-shaped suspension member has electrically conductive contact faces to be detachably connected to a conductor rail.

23. The mechanical holder of claim 22, wherein a first one of said contact faces is electrically connected to a first electrically conductive layer coated over a first side of said mechanical holder, and a second one of said contact faces is electrically connected to a second electrically conductive layer coated over a second side of said mechanical holder opposite said first side.

24. The mechanical holder of claim 23, wherein said hook-shaped suspension member can be mounted to a conductor rail including contact faces at different electrical potentials arranged on either side of an insulating layer such that gravitational force provides contact pressure, and said first one of said contact faces of said hook-shaped suspension member is pressed against a first one of said contact faces of said conductor rail, and said second one of said contact faces of said hook-shaped suspension member is pressed against a second one of said contact faces of said conductor rail.

25. A mechanical holding system comprising:

a mechanical holder for holding a decorative transparent member of a lighting system, said mechanical holder having a first end, and a second end opposite said first end and being shaped to support the decorative transparent member, said first end having a hook-shaped suspension member having electrically conductive contact faces; and a conductor rail including contact faces at different electrical potentials arranged on either side of an insulating layer, said mechanical holder being mounted to said conductor rail via said hook-shaped suspension member such that gravitational force provides contact pressure between said contact faces of said hook-shaped suspension member and said contact faces of said conductor rail.

* * * * *